US007987642B2

(12) United States Patent
Braid

(10) Patent No.: US 7,987,642 B2
(45) Date of Patent: Aug. 2, 2011

(54) WINDOW GLAZING UNIT FOR A BUILDING WINDOW ASSEMBLY

(76) Inventor: Simon Christopher Braid, Peterborough (GB)

( * ) Notice: Subject to any disclaimer, the term of this patent is extended or adjusted under 35 U.S.C. 154(b) by 63 days.

(21) Appl. No.: 12/295,322

(22) PCT Filed: Apr. 5, 2007

(86) PCT No.: PCT/GB2007/001243

§ 371 (c)(1),
(2), (4) Date: Sep. 30, 2008

(87) PCT Pub. No.: WO2007/128964

PCT Pub. Date: Nov. 15, 2007

(65) Prior Publication Data

US 2009/0301007 A1 Dec. 10, 2009

(30) Foreign Application Priority Data

Jul. 4, 2006 (GB) ..... 0607045.2

(51) Int. Cl.
*E06B 3/964* (2006.01)

(52) U.S. Cl. ..... 52/204.64; 52/204.62; 52/482

(58) Field of Classification Search ..... 52/475.1, 52/484.1, 495.1, 501, DIG. 1, 204.62, 204.64, 52/204.591, 204.593, 204.597, 482, 781.3, 52/786.1; 49/204.1, 204.64, 204.7, 213, 49/656.5, 475.1, 484.1, 495.1
See application file for complete search history.

(56) References Cited

U.S. PATENT DOCUMENTS

| | | | | | |
|---|---|---|---|---|---|
| 3,404,501 | A | * | 10/1968 | Von Wedel | 52/204.64 |
| 3,442,059 | A | * | 5/1969 | Kessler | 52/204.595 |
| 3,694,985 | A | * | 10/1972 | Spaiches | 52/204.597 |
| 3,861,444 | A | * | 1/1975 | Portwood | 160/90 |
| 3,992,843 | A | * | 11/1976 | DiFazio | 52/204.593 |
| 4,006,569 | A | | 2/1977 | Kain | |
| 4,640,072 | A | | 2/1987 | Muhle | |
| 5,379,518 | A | * | 1/1995 | Hopper | 29/897.312 |
| 5,379,560 | A | * | 1/1995 | Steller | 52/204.7 |
| 5,410,846 | A | * | 5/1995 | Frambach | 52/204.5 |
| 5,577,349 | A | * | 11/1996 | Rissone | 49/495.1 |
| 5,867,957 | A | * | 2/1999 | Holtrop | 52/403.1 |
| 2005/0055905 | A1 | * | 3/2005 | Sayer | 52/204.1 |

FOREIGN PATENT DOCUMENTS

| | | | |
|---|---|---|---|
| DE | 3236226 | A1 | 4/1984 |
| DE | 19628498 | A1 | 1/1998 |
| GB | 2251261 | A | 1/1992 |
| GB | 2279687 | A | 1/1995 |
| GB | 2309248 | A | 7/1997 |
| GB | 2314365 | A | 12/1997 |

* cited by examiner

*Primary Examiner* — Jeanette E Chapman
*Assistant Examiner* — Daniel Kenny
(74) *Attorney, Agent, or Firm* — Dickinson Wright PLLC

(57) ABSTRACT

Window assembly comprises a wedge packing assembly and/or a deformable packing assembly for fitting between a glazing unit and a frame of a window assembly to support the glazing unit within the Frame. The deformable packing assembly comprises a base, and a plurality of elongate deformable fingers which project from the base and upon which the glazing unit is supported. The fingers are arranged in an array on the base and are adapted to, in use, bend. The wedge packing assembly comprises a first wedge element having a base surface and an inclined surface at an angle to the base surface. The first wedge element is adapted to be fitted between the glazing unit and frame along an edge of the glazing unit with the inclined surface inclined at an angle to the normal of the plane of the glazing unit and window assembly. The wedge packing assembly may then further comprise a second wedge element.

22 Claims, 4 Drawing Sheets

WINDOW GLAZING UNIT FOR A BUILDING WINDOW ASSEMBLY

BACKGROUND OF THE INVENTION

1. Field of the Invention

The present invention relates to window assemblies for buildings, and in particular to mounting glazing units within window frames of such window assemblies. More specifically it relates to packing arrangements for fitting between the glazing unit and frame of a window assembly to support the glazing unit within the window frame.

2. Related Art

Windows comprise a glazing unit mounted within a surrounding frame. The glazing unit is typically a sealed double glazing unit comprising two parallel spaced apart panes of glass joined and sealed around their edges to enclose a space between the panes. The frame is made up from a number of sections, joined together at their ends and the corners of the frame. The frame may be made from wood, metal, or more commonly now plastic, for example uPVC. The inside edge of the frame defines a rebate to receive the glazing unit within the frame with the frame surrounding the glazing unit.

The frame and glazing units are manufactured separately, and must be matched so that the glazing unit fits within the frame. However due to manufacturing variability and tolerances, and to enable the glazing unit to be fitted into the frame, there is a varying clearance (typically up to 6 mm) between the glazing unit and frame. Accordingly in order to securely locate and fix the glazing unit within the frame, spacers or packing elements are fitted between the edges of the glazing units and frame. The spacers and packing elements are arranged take up the clearances between the frame and glazing unit to locate the glazing unit and wedge the glazing unit within the frame. In addition to locating the glazing unit within the frame, this also stiffens the frame and window assembly.

Conventionally such spacers or packing elements comprise pairs of wedges which are located between the glazing unit and frame. Each pair of wedges is arranged with their inclined surfaces overlying each other along the edge of glazing unit and within the plane of the glazing unit and frame. In use the wedges are slid relative to each other laterally parallel to plane of the window and along the edge of the glazing unit such that one wedge and inclined surface rides up over the other increasing the overall height of the overlying wedges and taking up the clearance between the glazing unit and frame. An example of such an arrangement is described in GB 2,251,261 A. GB 2,314,265 A shows (FIG. 3) a similar variable thickness packing arrangement comprising two angled wedges, although this patent is directed to door panels.

While such packing arrangements function adequately, the pairs of wedges are relatively difficult to fit between the glazing unit and frame. In addition it is relatively difficult and awkward to get access to the wedges to slide them laterally along the edge of and between the glazing unit and frame. Furthermore the glazing unit must be held in place within the frame until and whilst the wedges are slid to take up the clearance between glazing unit and frame to secure the glazing unit in place. This makes assembly difficult in particular for a single installer.

Alternative packing and spacing arrangements, and in particular packing elements to be fitted between the glazing unit and frame, are described in EP 0716206 and EP 0599051. These packing elements comprise a panel having a resilient projecting arcuate bulge oriented transversely to the panel and edge of the glazing unit. The packing element is fitted into the frame and the glazing unit then installed with the edge of the glazing unit riding up over and compressing the arcuate bulge. The clearance, and any variation in clearance, between the glazing unit and frame is taken up by the resilience and deformation of the arcuate bulge. Such packing elements can however only accommodate a limited variation in clearance between the glazing unit and frame and can be improved upon.

Various other glazing packing arrangements are described, for example, in:

GB 1,537,289, which describes the use of spacer elements comprising incompressible spacer blocks;

GB 1,150,807, which also shows the use of setting blocks to space the glazing unit form the frame;

GB 2,344,846, which a glazing packing arrangement which has an extension to secure and space a window bead;

EP 1,288,427, which describes an L shaped spacer block in which an arm of the spacer also holds the frame in the frame; and GB 2,309,248, which also descries an L shaped bead retaining spacer, but which in this case also shows flexible elements which engage and seal against the surface of the window pane.

It is also known to provide fixing member which engage the glazing unit to secure the glazing unit within the window frame. Such fixing member typically comprise upstanding projecting flanges, typically two spaced apart flanges between which an edge of the glazing unit is fitted with the flanges abutting the surfaces of the glazing unit. These fixing members may extend along the entire edge of the glazing unit and also act a water seal. Examples of such arrangements are described, for example, in U.S. Pat. No. 4,006,569, U.S. Pat. No. 4,640,072, and GB 2,279,687. GB2,212,545 also describes the use of a fixing member, but which this time is L shaped and includes on one upstanding flange.

It is desirable to provide an improved arrangement for mounting glazing units within window frames which addresses the above described problems and/or more generally offers an improvement and/or alternative to existing arrangements.

SUMMARY OF THE INVENTION

According to the present invention there is provided a deformable packing element, and packing assembly, as described in the accompanying claims. There is also provided in a further aspect a wedge packing assembly, as further described in the accompanying claims. In a yet further aspect of the invention there is provided a window assembly as yet further described in the accompanying claims.

In an embodiment of one aspect of the invention there is provided a deformable packing element for fitting between a glazing unit and a frame of a window assembly to support the glazing unit within the frame. The packing element comprises a base from which projects a plurality of elongate fingers arranged in an array and upon which the glazing unit is in use supported. The fingers are adapted to, in use, bend.

The fingers may comprise cylindrical projections. Alternatively, or additionally, the fingers may comprise projecting tabs or projecting ribs.

The height of the fingers from the base preferably varies over the array. In particular the plurality of fingers may be arranged in an array of rows and columns. The height of the fingers in a first row or column may then vary. Furthermore the height of fingers in a second adjacent row or column adjacent the first row may also vary. Preferably the height of fingers in the first row or column differ from the height of adjacent fingers in the second row or column with the height of the fingers in the first row or column, varying differently (or is at least staggered) to the height of the fingers in an adjacent row or column.

In a second aspect of an embodiment of the invention there may be provided a packing assembly for fitting between a glazing unit and frame of a window assembly to support the glazing unit within a frame. The packing assembly comprises a packing element as described above, and a cooperating wedge element having a base surface and an inclined surface at an angle to the base surface. The wedge element and inclined surface of the wedge element are, in use, supported on the fingers.

The inclined surface is preferably inclined at an angle to the normal of the plane of the glazing unit and window assembly.

In a yet further aspect of an embodiment of the invention there may be provided a wedge packing assembly for fitting between a glazing unit and frame of a window assembly to support the glazing unit within a frame. The packing assembly comprises a first wedge element having a base surface and an inclined surface at an angle to the base surface. The first wedge element is adapted to be fitted between the glazing unit and frame along an edge of the glazing unit with the inclined surface inclined at an angle to the normal of the plane of the glazing unit and window assembly.

The wedge packing assembly preferably further comprises a second wedge element having a base surface and an inclined surface at an angle to the base surface. The second wedge element, in use, is oppositely disposed on top of first element with the inclined surface of first element abutting and being supported on the inclined surface of the second wedge element.

In yet another further aspect of an embodiment of the invention there may be provided a window assembly comprising a glazing unit, a frame surrounding the glazing unit and within which the glazing unit is fitted, and at least one packing assembly fitted between a glazing unit and frame of a window assembly to support the glazing unit within the frame. A first packing assembly is fitted between the glazing unit and frame. The first packing assembly acts in a first direction. A second packing assembly is also preferably fitted between the glazing unit and frame and acts in a second direction perpendicular to the first direction.

The first and second packing assemblies preferably comprise a single corner packing assembly located and acting at a corner of glazing unit and frame.

The first and second packing assemblies together, in use, preferably generate a diagonal loading between and across the frame and glazing unit in a diagonal direction across the glazing unit in the plane of the glazing unit.

BRIEF DESCRIPTION OF THE DRAWINGS

The present invention will now be described by way of example only with reference to the following figures in which.

DETAILED DESCRIPTION OF THE PREFERRED EMBODIMENT

Figure 1:
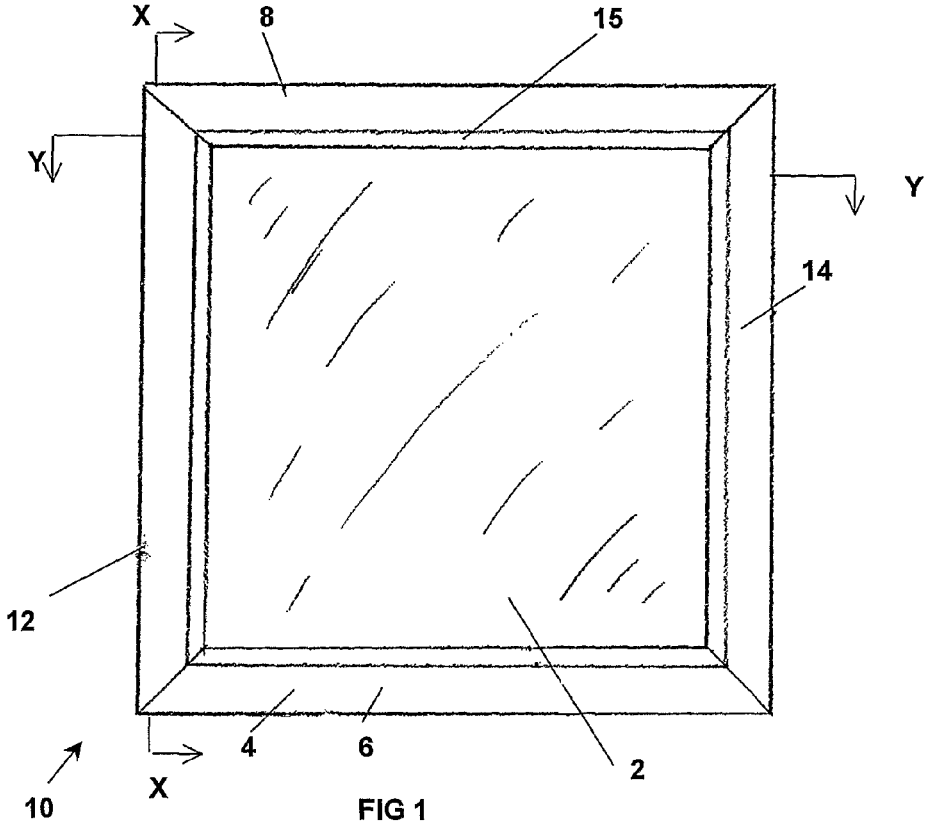
FIG. 1 is a schematic front view of a window assembly.

Referring to the Figures, wherein like numerals indicate like or corresponding parts throughout the several views, Referring to FIG. 1 a window assembly 10 comprises a glazing unit 2 mounted within a surrounding frame 4. The glazing unit 2 is typically a sealed double glazing unit comprising two parallel spaced apart panes of glass 2*a*,2*b* which are joined and sealed around their edges to enclose the space 2*c* between the panes 2*a*,2*b*. The frame 4 is made up from a number of sections 6,8,12,14 joined together at their ends to form the corners of the frame 4. The frame 4 may be made from wood, metal, or more commonly now plastic, for example uPVC. A rebate is defined along the inside of the frame 4 to receive the glazing unit 2 within the frame 4 with the frame 4 surrounding the glazing unit 2. In particular, as shown, the front of the frame 4 and rebate includes an inwardly extending front flange 15 against which a front face and front pane 2*a* of the glazing unit abuts. Once the glazing unit 2 is fitted within the frame a rear bead (not shown) is installed against the rear face and rear pane 2*b* of the glazing unit 2 such that the glazing unit 2 is located and secured between the front flange 15 an rear bead.

It will be appreciated that reference to 'front' and 'rear' refer to the installed positions of the window assembly 10, in the particular arrangement shown and may be reversed in other embodiments.

The frame 4 may have other configurations to that shown, and may for example be subdivided to define openings for and rebates to receive further glazing units 2 within the frame. In addition the window assembly 10 and frame 4 may be movably mounted, for example pivotally mounted, within a further outer frame (not shown) to provide an opening window. The outer frame may also include further glazing units 2 and/or window assemblies 10 mounted therein.

Referring in more detail to FIGS. 2 to 10 packing assemblies 16,17 are mounted at the corners of the glazing unit 2 between and along the edges of the glazing unit 2 and an inside edge of the frame 4. The packing assemblies 16,17, as will be described further below, are adjustable and have a variable thickness t,t' (in a direction parallel to the plane of the glazing unit 2 and window 10) to fill the clearance between the glazing unit 2 and frame 4 and abut and press against the edges of the glazing unit 2 and frame 4. The packing assemblies 16,17 thereby take up the clearance, and any manufacturing variations in the clearance between the glazing unit 2 and frame 4 and locate the glazing unit 2 within the frame 2. In addition the packing assemblies 16,17 apply a load (in the plane of the window 10 and glazing unit 2) between the glazing unit 2 and frame 4 to frictionally secure the glazing unit 2 within the frame 4. This loading, and the secure location and fixing of the glazing unit 2 within the frame 4, also stiffens the frame 4 and whole window assembly 10.

The upper packing assemblies, located at the upper corners of the window 10, each comprise a deformable packing assembly 16 comprising a deformable packing element 18 and a corresponding cooperating wedge packing element 20.

The wedge packing element 20 is generally rectangular and has a generally constant cross section along its length L. The wedge packing element 20 has a flat planar base surface 22 and an opposite facing inclined planar surface 24 at an angle to the base surface 22 on the opposite side of the wedge packing element 20 such that the thickness of the wedge packing element 20 $t_w$ tapers across the width W of the wedge packing element 20. When the wedge packing element 20 is installed along the edge of the glazing unit 2 the base surface 22 is arranged to abut against the edge of the glazing unit 20 and is parallel to the edge of the glazing unit 2 and parallel to the normal of the plane of the glazing unit 2. The inclined surface 24 is accordingly inclined at an angle to the normal of the plane of the glazing unit 2 and window assembly 10 and the wedge packing element 20 tapers in a direction perpendicular to the plane of the window 10 and glazing unit 2.

Upstanding side flanges 26 project from the base surface 22 and extend along either lateral side of the wedge packing element 20. The side flanges 26 and base surface 20 define a channel section 28 within which the glazing unit 2 fits with the side flanges abutting against the faces of the panes 2*a*,2*b* of the glazing unit 2. The side flanges 26 secure the wedge element 20 to and along the edge of the glazing unit 2. In other embodiments however the wedge element 20 may be fixed to the glazing unit in other ways, or even not fixed at all. The wedge packing element 20 may also be incorporated and integral with the glazing unit 2.

The deformable packing element 18 is generally rectangular and comprises a base 30 having a planar base surface 32. The deformable packing element 18 and base 30 are arranged to fit within a channel section 34 defined by the inside surface of the frame 4 with the base 30 preferably having a stepped profile and flange along one lateral side which abuts against an edge profile of the frame channel 34 to locate the deformable element 18 within the channel 34. The opposite side of the deformable element 18 abuts against the front flange 15 of the window frame 4 with the base surface 32 abutting against the bottom of the channel 34 and inside surface of the frame 4. Of course in other embodiments the deformable element 18 and base 30 may be fitted and located within the frame 4 in other ways.

A plurality of individual deformable fingers 36 project from the base 30 of deformable packing element 18. The plurality of deformable fingers 36 are arranged in an array, and preferably as shown in rows and columns across the width and length base 30 of the deformable packing element 18.

In this embodiment each of the deformable fingers 36 comprises a generally rectangular planar tab oriented side on with the width of the tab extending longitudinally with respect to the length of the deformable element and, when installed in the window assembly 10 the width extending generally laterally with respect to the window 10. In their undeflected state, the tabs are generally parallel to the plane of the window 10.

When assembled and fitted between the edge of the glazing unit 2 and frame 4 the deformable element 18 cooperates with and abuts against the corresponding cooperating wedge element 20 with the inclined surface 24 of the wedge element 20 abutting and being supported on the distal ends of the fingers 36.

Figure 6:
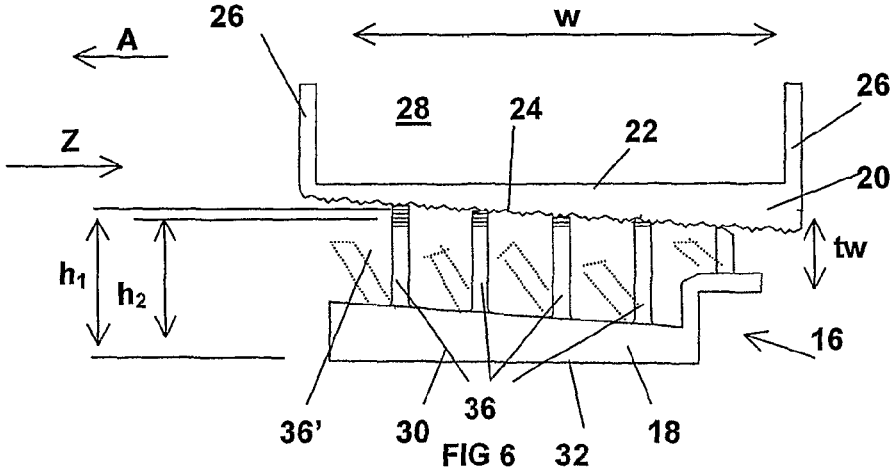
FIG. 6 is a more detailed schematic cross sectional view of the cooperating wedge and deformable packing elements of the packing assembly shown in FIGS. 2 to 5.
Figure 7:
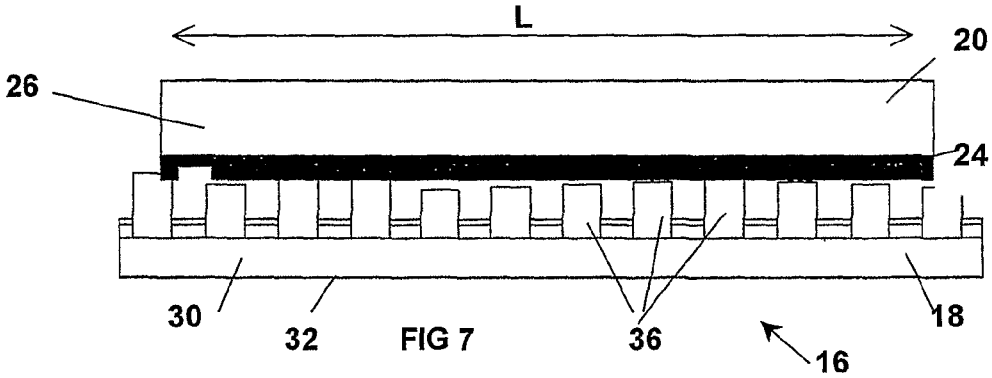
FIG. 7 is a front view on arrow Z of the cooperating wedge and deformable packing elements shown in FIG. 6.
Figure 8:
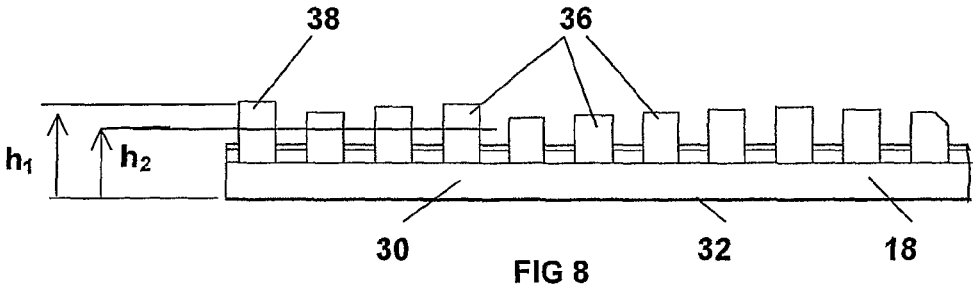
FIG. 8 is a front view of the one of the cooperating wedge and deformable packing elements shown in FIG. 6.

The deformable packing element 16, and specifically fingers 36 are made of a flexible resilient material, preferably a plastic such that the fingers 36 are flexible and can be deformed and deflected, as shown in phantom in FIG. 6. Specifically the fingers 36 are adapted and arranged to be deflected during assembly by the corresponding wedge element 20. Accordingly the fingers 36 can be bent into a deflected state such that the thickness t of the packing assembly 16 matches, and is dependent upon the clearance between the frame 4 and edge of the glazing unit 2. In this regard it will be appreciated that the thickness t of the packing assembly 16, from the base surface 32 of the deformable packing element 18, which abuts against the frame 4, to the base surface 22 of the wedge packing element 20 which abuts against the edge of the glazing unit 2 varies depending upon the deflection and amount of bending of the deformable fingers 36. Once installed the deflection and bending of the fingers 36 then urges the wedge packing element 20 away from the deformable element 18 and generates a force perpendicular to the base surfaces 22,32 in the plane of the window 10 and glazing unit 2 and between the glazing unit 2 and the frame 4. It will be appreciated that the deformable packing element 18 and fingers 36 are shown schematically in their natural undeflected state with the packing assembly 16 at its maximum expanded condition and thickness t.

To assemble the window 10, in this preferred embodiment, the deformable packing elements 18 are fitted into the window frame 34, and the corresponding wedge packing elements 20 are fitted onto the edges of the glazing unit 2. The glazing unit 2 and wedge packing elements 20 are then fitted and inserted into the window frame 4 in a direction perpendicular to the plane of the window, as indicated by arrow A. The glazing unit 2 is pushed forwards until it abuts against the front flange 15. As the glazing unit 2 is inserted the wedge element 20 is inserted and specifically the inclined surface 24 is slid over the ends of the deformable fingers 36, and is pressed against the deformable element 18 and onto the fingers 36. This deflects the fingers 36 as shown in phantom in FIG. 6, to reduce the thickness t of the packing assembly 16 and allow the glazing unit 2 to be fitted into the frame 4 with the packing assembly 16 between the glazing unit 2 and frame 4. In other words the deformable packing element 18 and fingers 36 are squashed, reducing the height and thickness t of the packing assembly 16 to allow the glazing unit 2 to be fitted into the frame 4. Once installed the fingers 36 attempt to spring back to their natural undeflected and undeformed state, urging the wedge element away from the deformable element 18 and expanding the thickness t of the packing assembly 16. This generates a force in the plane of the window 10 and glazing unit 2 acting between the glazing unit 2 and frame 4 to secure and centre the glazing unit 2 within the frame 4 and take up any clearances between the glazing unit 2 and frame 4.

The angle and inclination of inclined surface 24 of the wedge element 20 assists in deflecting the fingers 36 and allows easier insertion of the wedge element 20 and glazing unit 2 between the distal ends 38 of the fingers 36 and glazing unit 2, with the wedge element 20 tapering from a forward end.

To further assist and allow easier installation of the glazing unit 2 and packing assembly 16 the height h of the fingers 36 may also decrease across the width w (i.e. in the direction perpendicular to the plane of the window 10 and opposite to the direction of installation of the glazing unit 2) of the deformable element 18 corresponding to the inclination of the inclined surface 24 of the wedge element 20. In particular the fingers 36 in the first rows of the deformable element may have an average height h (measured form the base surface 32) that is lower than the average height h of the fingers in the later rows (to the left in FIG. 6) and nearer the front flange 15 of the frame 4 when installed.

The height h and length of the fingers 36 preferably varies over the array of fingers 36. In particular the height h varies from a maximum h1 to a minimum h2 in each row of fingers 36 and/or in each column of fingers 36. Preferably the height varies differently in both each row and column, and/or the variation in height in each row and column is staggered, such that the height varies between adjacent fingers 36. Furthermore, this variation in height h is not simply an linear increase, but, as shown for example more clearly in FIG. 8 the height's of adjacent fingers across a row of the array (or similarly along a column, and more generally over the array) may increase and then decrease. The variation may also be within an overall average increase across the width of the array, or instead of any such average variation. As a result, in the preferred arrangement the array of fingers 36 has a distribution of different heights h across the array. This variation in and distribution of heights h of the fingers 36 enables the packing assembly 16, and in particular deformable element 18, to accommodate and support the glazing assembly 2 adequately over a range of different thickness t of the packing element 16, and so clearances between the glazing unit 2 and frame 4. In particular the range of heights h1 and h2, and height h of the fingers 36 are set and chosen to correspond to the variation range of different anticipated clearances (due to different tolerances etc) and so required thickness t for the packing assembly 16 such that for any given clearance and required thickness t at least some of the fingers 36 are preferably undeflected and have their distal ends 38 in contact with the wedge element 20 to support the wedge element 20 and provide rigid packing and support of the glazing unit 2 within the frame 4. It will be recognized that the undeflected fingers 36 with the wedge element 20 resting on their distal ends 38 provide a more rigid support than deflected fingers 36. The distribution of fingers 36 of different heights h further ensures the packing assembly 16, for any given required thickness t, provides an even support and loading between the frame 4 and glazing unit 2 over its entire area.

The cooperating inclined surface 24 of the wedge element 20 is preferably roughened, and preferably includes longitudinally extending ribs to increase the engagement between the distal ends 38 of the fingers 36 and inclined surface 24 and so wedge element 20.

Figure 11:
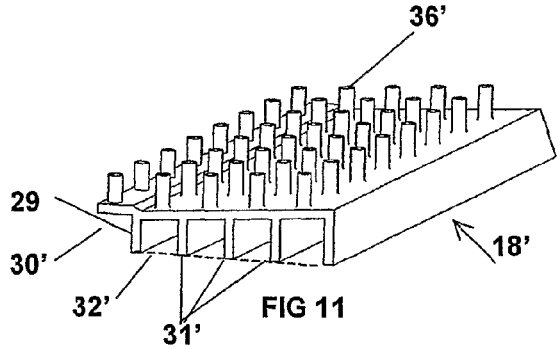
FIG. 11 is a perspective view of an alternative deformable packing element.
Figure 12:
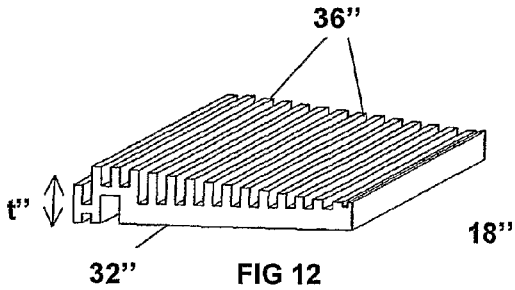
FIG. 12 is a perspective view of further alternative deformable packing element.
Figure 2:
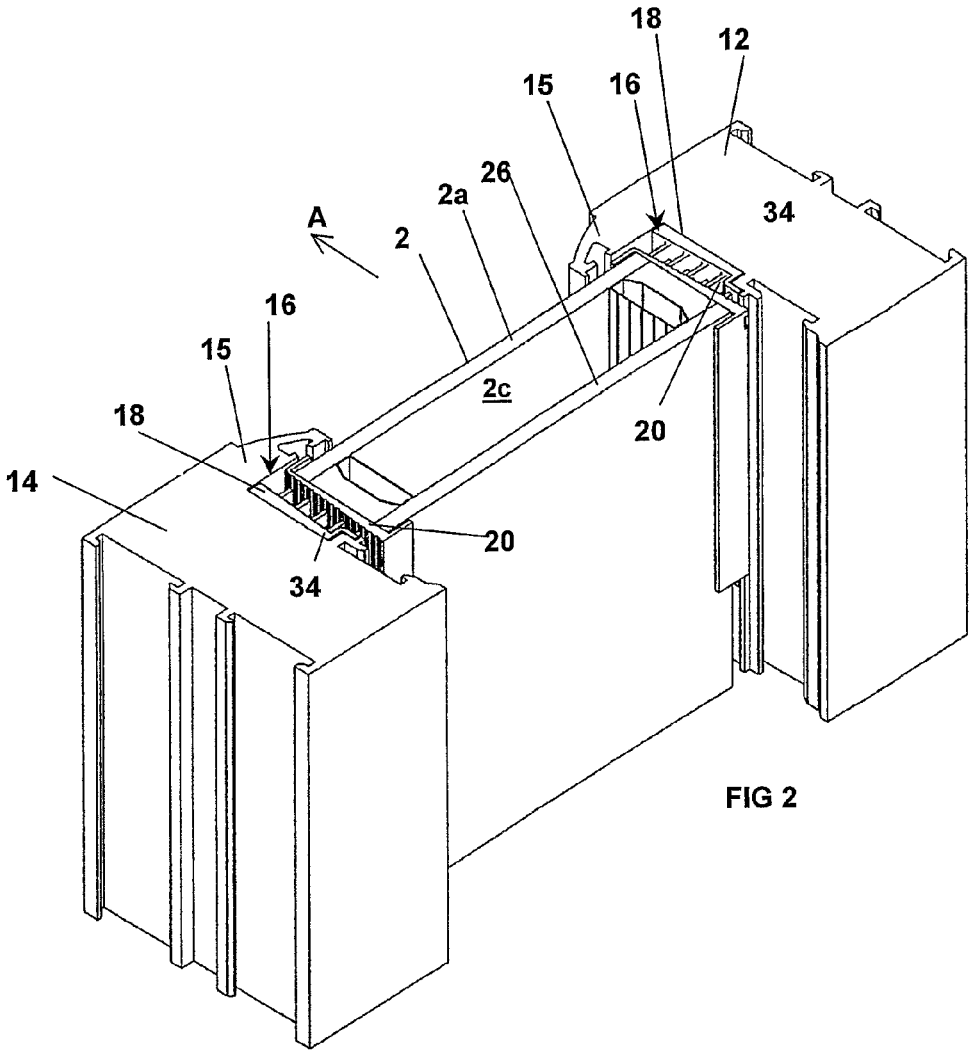
FIG. 2 is a schematic perspective horizontal sectional view on Y-Y of the window assembly shown in FIG. 1.
Figure 3:
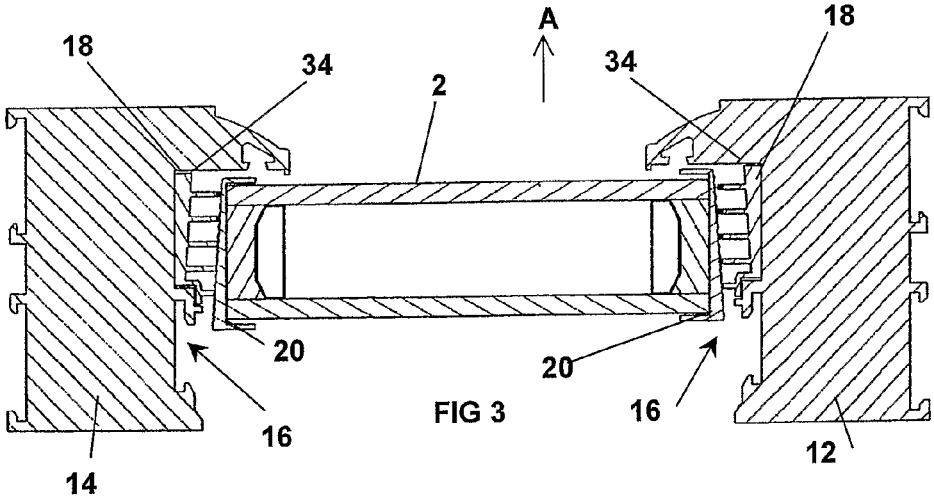
FIG. 3 is a schematic horizontal cross sectional view on Y-Y of the window assembly shown in FIG. 1.
Figure 5:
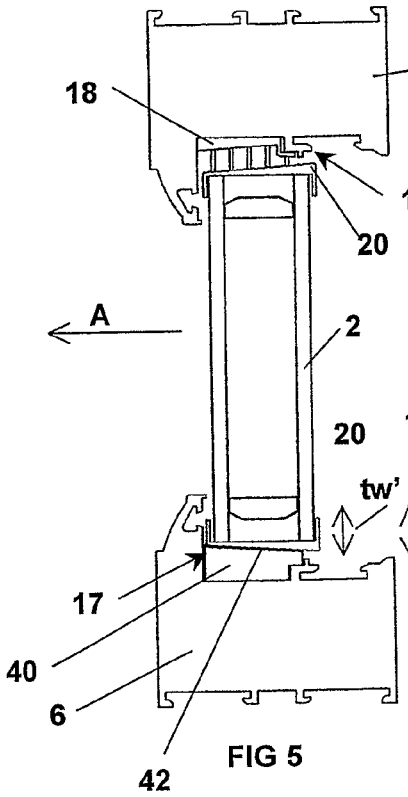
FIG. 5 is a schematic cross sectional view on X-X of the window assembly shown in FIG. 1.
Figure 4:
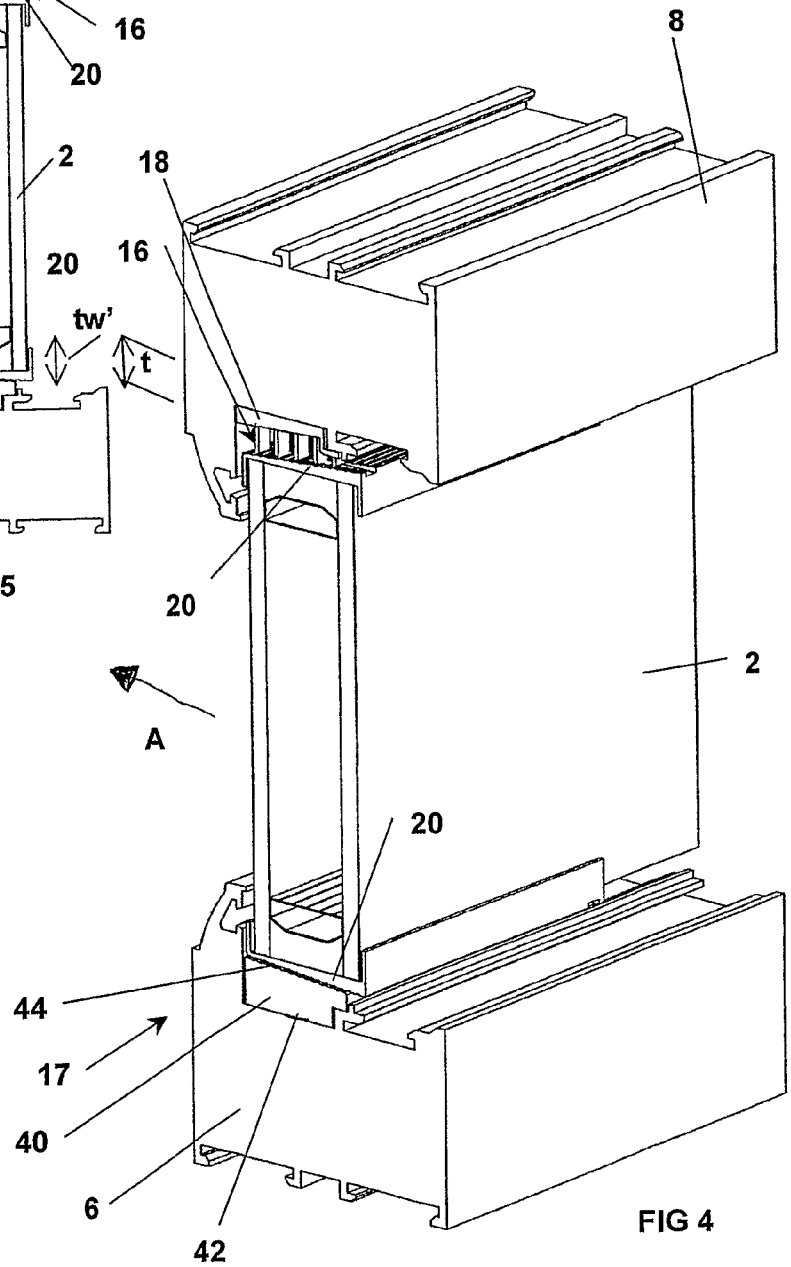
FIG. 4 is a schematic perspective sectional view on X-X of the window assembly shown in FIG. 1.
Figure 9:
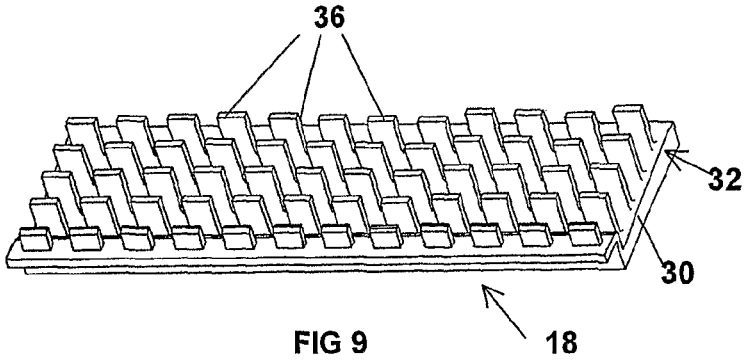
FIG. 9 is a perspective view of the deformable packing element shown in FIG. 6.

The deformable packing element 18, and deformable fingers 36 may have other configurations. For example as shown in the embodiment of FIG. 11 the base 30 of the deformable member 18 may have an open configuration and a shown in FIG. 11, and may comprise a plurality of longitudinal ribs 29 having distal ends 31' which together form the base surface 32' as illustrated in phantom in FIG. 11. Furthermore as shown in FIG. 11 the deformable fingers 36*a* of the deformable element 18*a* may comprises cylindrical pillars. The deformable fingers may further alternatively comprise flexible deformable ribs 36", as shown in FIG. 12. As shown the ribs 36" extend, similarly to the tabs 36 shown in FIG. 9, are oriented longitudinally along the length of the deformable packing element 18" and when installed oriented laterally with respect to the frame 4 along the edges and parallel to the plane of the window 10. The ribs 36" are arranged in rows with the height h of the ribs 36", and specifically height of the distal ends of the ribs 36" above the base surface 32", and so thickness t of the deformable packing element 18" varying from one row to the next and over the deformable packing element 18". In this case the height h of the ribs 36" is constant along each rib 36" and only varies from one rib to the next. As such the deformable packing element 18 simply tapers in one direction in this embodiment, and so is less preferred to the other embodiments shown in for example FIGS. 9 and 11. The base 30" of this deformable packing element 18" also differs from the other embodiments and simply fits into the channel 34 in the frame 4. Other variations will also be apparent to those skilled in the art.

While as described the wedge element 20 is fitted to the glazing unit 2 prior to installing the glazing unit 2 in the frame 4, in alternative arrangements the wedge element 20, and/or deformable packing element 18, and/or packing assembly 16 as a whole may be fitted after the glazing unit, with for example the wedge element 20 being inserted between the distal ends 38 of the fingers 36 and edge of the glazing unit 2. Certain modifications to the mounting arrangements of the wedge and/or deformable packing element 18,20 may however be required to allow for such subsequent insertion and fitment.

In other embodiments the positions of the deformable 18 and wedge packing elements 20 may be reversed with the wedge element 20 installed on the frame and the deformable element mounted on the glazing unit. Also in other alternative less preferred embodiments and aspects of the invention however the wedge element 20 could be omitted with the distal ends 38 of the fingers 36 directly abutting the edge of glazing unit 2. Alternatively the wedge element 20 may have a parallel surfaces parallel to the edge of the glazing unit 2.

The lower packing assembly 17 of the window assembly 10 shown in the figures, differs from that of upper packing assembly described above, and the lower packing assembly in itself comprises a separate aspect and embodiment of the invention. The lower packing assembly 17 could however in other embodiments and window assemblies be replaced with a packing assembly identical to the upper packing assembly 16 described above.

The lower packing assembly 17 comprises a wedge packing assembly and comprises a first wedge packing element 20 and second wedge packing element 40. The first wedge packing 20 element is identical to the wedge packing element 20 of the upper packing assembly 16 and is similarly mounted on the glazing unit 2.

The second frame wedge packing element 40, which replaces the deformable packing element 18 used in the upper packing assembly 16, corresponds to and cooperates with the first wedge packing element 20 mounted on the glazing unit 2. The second frame wedge element 40 has a flat planar base surface 42 and an opposite facing inclined planar surface 44 at an angle to the base surface 42 on the opposite side of the second wedge packing element 20. The thickness $t_w$, of the wedge packing element 40 tapers across the width W of the wedge packing element 40. The second wedge packing element 40 is adapted to fit within a channel section 34 defined by the inside surface of the frame 4 with the base 41 having a stepped flange profile along one lateral side which abuts against an edge profile of the frame channel 34 to locate the second wedge element 40 within the channel 34. The opposite side of the second wedge element 18 abuts against the front flange 15 of the window frame 4 with the base surface 42 abutting against the bottom of the channel 34 and inside surface of the frame 4. Of course in other embodiments the second wedge packing element 40 may be fitted and located within the frame 4 in other ways. The inclined surface 44 is arranged such that when the wedge packing element 40 is installed, the inclined surface 44 is inclined at an angle to the normal of the plane of the glazing unit 2 and window assembly 10 and tapers in a direction perpendicular to the plane of the window 10 and glazing unit 2. Then inclined surface 44 is furthermore arranged to cooperate with and correspond to the inclined surface 24 of the first wedge packing element 20, and is inclined and tapers in the opposite sense/direction.

During assembly the second wedge packing element 40 is be fitted and located within the frame 4. The first wedge packing element 20 is then fitted and inserted into the window frame 4 in a direction perpendicular to the plane of the window, as indicated by arrow A. Preferably the first wedge packing element 20 is mounted on the glazing unit 2 and inserted with the glazing unit. However the wedge packing element 20 may be inserted after the glazing unit 2 and between the glazing unit 2 and second wedge packing element 40, although some modification of the wedge packing element 20 will be required to allow for such subsequent separate insertion.

As the wedge element 20 is inserted and specifically the inclined surface 24 slid over the corresponding inclined surface of the second wedge packing element 40 the thickness t' (measured between the respective base surfaces 22,42) of the packing assembly 17 increases. This generates a force in the plane of the window 10 and glazing unit 2 acting between the glazing unit 2 and frame 4 to secure and centre the glazing unit 2 within the frame 4 and take up the clearance between the glazing unit 2 and frame 4 while allowing the glazing unit 2 to be easily installed.

While the lower wedge packing assembly 17 allows easy installation and takes up the clearance between the frame 4 and glazing unit 2 to secure and locate the glazing unit 2, the lower packing assembly 17 cannot readily accommodate any variations in the clearance between the frame 4 and glazing unit 2. The final thickness t' of the packing assembly 17 is fixed. Accordingly, and as shown the wedge packing assembly 17 is typically used in conjunction with a deformable packing assembly 18 (or other variable packing) which can accommodate such variations. Of course if there is no variation in the clearance and packing required then the wedge packing assembly 17 could be used on its own, and in place of the more complex deformable packing assemblies 16.

In a variation of the wedge packing assembly 17, and to provide variable thicknesses t' of the packing assembly 17 to accommodate variations in the clearances, one of the wedge packing elements 20,40 could be modified such that it is arranged to be inserted and positioned to a varying amount over the other corresponding element, rather than being positioned to direct overlap the other element and into a fixed home position as shown. In such a case so that the wedge element does not undesirably project and protrude from the plane of the glazing unit 2 and/or frame 2 when not fully inserted, the wedge element may have a width W less than that of the glazing unit 2 such that they are inserted under the glazing unit 2. Alternatively the wedge element may be arranged such that part (or parts) of the wedge element which may project when not fully inserted when not fully inserted is frangible and be snapped off.

The first wedge packing element 20 may also be omitted from the wedge packing assembly 17 with the edge of the glazing unit 2 simply abutting and being directly supported on the inclined surface 44 of the second wedge packing element 40. Similarly the first wedge packing element 20 could be used on its own without the second wedge packing element 40 with the inclined surface 24 of the first wedge packing element 20 abutting against the frame 4 (or a further flat spacer). Such arrangements are however less preferred since it does not support the edge of the glazing unit 2 over its entire thickness. The positions of the first and second wedge packing elements 20,40, whether used together or separately could also be reversed.

The packing assemblies 16,17 when installed generate and apply a loading between the edge of the glazing unit 2 and inside edge of the frame 4. This loading acts in the plane of the glazing unit 2 and window 10 and perpendicular to the edge of the glazing unit 2 and inside edge of frame and bases surfaces 22,32,42. Accordingly the packing assemblies 16,17 mounted along the top and bottom edges of the window assembly 10 apply and generate a vertical acting force, and the packing assemblies 16 mounted on the sides of the window assembly 10 generate and apply a lateral horizontal loading and force. As a result, and by mounting the packing assemblies 16,17 around the frame 4, the packing assemblies 16,17 and loading centre the glazing unit 2 within the frame 4. It will also be appreciated that packing assemblies 16,17 could be provided only along two adjacent sides and edges of the glazing unit 3, acting in orthogonal directions (in the case of the usual rectangular glazing unit and window) with the opposite sides and edges of the glazing unit 2 simply abutting against the frame 4. Indeed in a yet further variant packing assemblies could be located on and between only one edge of the glazing unit 2 to generate and apply only loading and location of the glazing unit 2 in only a single direction, with the location of the glazing unit 2 in the other direction being free. This is however less preferred.

As shown the packing assemblies are preferably located at the corners of the glazing unit 2 and frame 4. Packing assemblies 16,17 located at the corners act together to generate a diagonal loading on and between the glazing unit 2 and frame 4 extending across and in the plane of the glazing unit 2 and frame 4. This urges the diagonally opposite corner of the glazing unit 2 into the diagonally opposite corner of the frame 4. Such diagonal loading of the frame 4 is particularly desirable since it braces and stiffens the window assembly 10 as a whole reducing twisting and flexing of the window frame 4 and window 10. This is particularly important for opening windows in which the frame 4 is movably mounted within a further frame (not shown) and in which the frame 4 is subject to asymmetric loading due to the movable (pivotable) mounting of the frame 4 about one side or edge which can result in twisting and distortion of the frame 4. In such a case, with the window 10 pivotally mounted by a hinge on one side, the packing assemblies 16,17 are in particular arranged to apply a diagonal loading from the bottom lower end of the hinge side of the window 10 towards the opposite upper corner of the window 10 to lift the glazing unit 2 within the frame 4 and keep the frame 4 square when opened and supported along the hinge side alone. Such diagonal loading is known in the art as 'toe and healing'.

Figure 10:
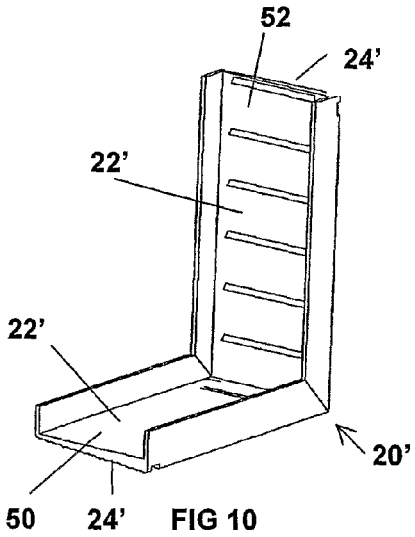
FIG. 10 is a perspective view of a variant of the wedge packing element shown in FIG. 6.

Rather than comprising separate elements along each side of the glazing unit 2, the packing assemblies 16,17, and/or some of all of the packing elements 20,18,40 could be integrated into unitary corner packing assemblies or elements mounted and fitted over and in the corners. For example as shown in FIG. 10 a unitary corner wedge packing element 20' may comprise a first portion 50 adapted to be mounted along one edge of the glazing unit 2, and a second portion 52, adapted to be at an angle, preferably perpendicular to the first portion 50, and adapted to be mounted to a second edge of the glazing unit 2. Each of the portions of the corner wedge element 20' corresponds to the wedge element 20 previously described and includes a base surface 22' and inclined surface 24'. Similarly a corner mounted deformable packing element, comprising two deformable elements 18 joined and linked at their ends, could be used.

While locating packing assemblies 16,17 at the corners is the preferred arrangement packing assemblies 16,17 could be located elsewhere along the glazing unit 2 and frame 4 instead of, or in addition to packing assemblies 16,17 located at the corners. In particular for large window 10 further packing assemblies may be required along the edge of the glazing unit 2 to provide additional packing and support of the glazing unit 2 within the frame 4.

The wedge packing elements 20 are, as shown, preferably installed on the glazing unit 2 prior to installation of the glazing unit 2 within the frame 4. The wedge packing element 20 in particular when mounted on the corners of the glazing unit 2, protects the edges and vulnerable corners of the glazing unit from damage prior to and also during installation of the glazing unit 2 within the frame 4. In addition, the glazing unit 2 can be more securely stood up at an angle on the inclined surface 24 of the wedge element 20.

Preferably, as described, the respective packing elements 18,20,40 are fitted to the frame 4 and glazing unit 2 prior to installation of the glazing unit 2 within the frame 4. The glazing unit 2, and packing elements 20 thereon, is then simply inserted into the frame 4 with the packing assemblies 16,17 then taking up the clearances between the glazing unit 2 and frame 4 and securing the glazing unit 2 within the frame 4. As a result as the glazing unit 2 is inserted into the frame 4 it is automatically located and at least temporarily fixed in position within the frame 4 by the packing assemblies 16,17, with the deformable element 18 accommodating any variation in clearance between the frame 4 and glazing unit 2. The packing elements 18,20,40 also assist in guiding the glazing unit into position within the frame 4.

While the embodiments show and relate to a typical square or rectangular window 10 and frame 4, it will be appreciated that the invention is also applicable to other shapes of windows 10.

The principle and mode of operation of this invention have been explained and illustrated in various embodiments. However, it must be understood that this invention may be practised otherwise than as specifically explained and illustrated without departing from its scope. The scope of the invention is defined by the claims, wherein reference numerals are provided merely for convenience and not to be considered in any way limiting.

The invention claimed is:

1. A window assembly (10) comprising:

a frame (4) having at least one inside edge;

a glazing unit (2) mounted within the frame (4), the glazing unit (2) being generally planar and having at least one outer edge disposed in parallel opposing relation to the inside edge of the frame (4);

a deformable packing element (18) for fitting between and at a location along the outer edge of the glazing unit (2) and the inside edge of frame (4) to support the glazing unit (2) within the frame (4), the deformable packing element (18) extending only part way along the outer edge of the glazing unit (2) and the inside edge of the frame (4);

the packing element (18) including a base (30), and a plurality of elongate deformable fingers (36) which project from the base (30) to respective distal ends (38) in a direction parallel to the plane of the glazing unit (2) and upon which the glazing unit (2) is in use supported, the fingers (30) being arranged in an array on the base (30) and being adapted to, in use, bend when operatively positioned directly between the outer edge of the glazing unit (2) and the inside edge of frame (4).

2. A deformable packing element (18) of claim 1 in which the fingers (36') comprise cylindrical projections.

3. A deformable packing element (18) of claim 1 in which the fingers (36) comprise projecting tabs.

4. A deformable packing element (18) of claim 1, wherein each finger has a height measured from the base, and in which the height (h,h1,h2) of the fingers (36) from the base (30) varies over the array.

5. A deformable packing element (18) of claim 1 in which the plurality of fingers (36) are arranged in an array of rows and columns.

6. A deformable packing element (18) of claim 5 wherein each finger has a height measured from the base, and in which the height (h,h1,h2) of the fingers (36) in a first row or column varies.

7. A deformable packing element (18) of claim 6 wherein the array of fingers (36) includes at least two rows or columns, and in which the height (h,h1,h2) of the fingers (36) in a second row or column adjacent a first row also varies, and in which the height (h,h1,h2) of the fingers (36) in the first row or column differs from the height (h,h1,h2) of the corresponding adjacent fingers (36) in the second row or column.

8. A deformable packing element (18) of claim 1 in which the base (30) is adapted to, in use, abut against the window frame (4), and the fingers (36) project toward the glazing unit (2) mounted within the frame (4).

9. A deformable packing element (18) of claim 1 in which the base (30) comprises first planar base portion (50) and a second planar base portion (52) adapted to be oriented at an angle to the first base portion (50).

10. A window assembly (10) of claim 1 wherein the packing element (18) is configured for fitting between the glazing unit (2) and the frame (4) at a discrete location along an edge of the glazing unit (2) to support the glazing unit (2).

11. A deformable packing element (18) of claim 1 in which the fingers (36) are arranged in laterally and longitudinally spaced relation to one another in said array on the base (30).

12. A window assembly (10) comprising:

a frame (4) having at least one inside edge;

a glazing unit (2) mounted within the frame (4), the glazing unit (2) being generally planar and having at least one outer edge disposed in parallel opposing relation to the inside edge of the frame (4);

a packing assembly (16) for fitting between the glazing unit (2) and the frame (4) to support the glazing unit (2) within the frame (4), the packing assembly (16) extending only part way along the outer edge of the glazing unit (2) and the inside edge of the frame (4);

the packing assembly (16) including a packing element (18) having a base (30) and a plurality of elongate deformable fingers (36) which project from the base (30) in a direction parallel to the plane of the glazing unit (2) and upon which the glazing unit (2) is in use supported, the fingers (30) being arranged in an array on the base (30) and being adapted to, in use, bend, and the packing assembly (16) further including a cooperating wedge element (20) having a base surface (22) and an inclined surface (24) at an angle to the base surface (22), the wedge element (20) and inclined surface (24) of the wedge element (20) in use being supported on the fingers (36) and interactive therewith such that relative movement between the wedge element (20) and packing element (18) causes the fingers (30) to bend when operatively positioned directly between the outer edge of the glazing unit (2) and the inside edge of frame (4).

13. A packing assembly (16) of claim 12 in which the inclined surface (24) is inclined at an angle to the normal of the plane of the glazing unit (2) and window assembly (10).

14. A packing assembly (16) of claim 12 in which the base (22) of the wedge element (20) abuts against an edge of the glazing unit (2).

15. A packing assembly (16) of claim 14 in which the wedge element (20) is adapted to be mounted upon the glazing unit (2).

16. A packing assembly (16) of claim 12 in which the wedge element (20) comprises a flange (26) projecting from base surface (22) of wedge element (20) and adapted to locate against a face of the glazing unit (2).

17. A packing assembly (16) of claim 12 in which the wedge element (20) comprises a first planar base portion (50) and a second planar base portion (52) adapted to be oriented at an angle to the first base portion (50).

18. A window assembly (10) of claim 12 comprising at least a first packing assembly (16) fitted between the glazing unit (2) and frame (4) and acting in a first direction, and a second packing assembly (16) fitted between the glazing unit (2) and frame (4) and acting in a second direction perpendicular to the first direction.

19. A window assembly (10) of claim 18 in which the first and second packing assemblies (16) comprise a single corner packing assembly (20') located and acting at a corner of glazing unit (2) and frame (4).

20. A window assembly (10) of claim 12 in which the first and second packing assemblies (16) together, in use, generate a diagonal loading between and across the frame (4) and glazing unit (2) in a diagonal direction across the glazing unit (2) in the plane of the glazing unit (2).

21. A window assembly (10) of claim 12 wherein the packing element (18) is configured for fitting between the glazing unit (2) and the frame (4) at a discrete location along an edge of the glazing unit (2) to support the glazing unit (2).

22. A window assembly (10) of claim 20 wherein the packing element (18) is configured for fitting between the glazing unit (2) and the frame (4) at a discrete location along an edge of the glazing unit (2) to support the glazing unit (2).

* * * * *